US006361380B1

(12) United States Patent
Steinhauser et al.

(10) Patent No.: US 6,361,380 B1
(45) Date of Patent: Mar. 26, 2002

(54) ELECTRICAL PLUG-IN CONNECTION

(75) Inventors: Uwe Steinhauser, Filderstadt; Stefan Fenger, Waiblinger, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/719,694

(22) PCT Filed: Feb. 23, 2000

(86) PCT No.: PCT/DE00/00507

§ 371 Date: Feb. 28, 2001

§ 102(e) Date: Feb. 28, 2001

(87) PCT Pub. No.: WO00/64013

PCT Pub. Date: Oct. 26, 2000

(30) Foreign Application Priority Data

Apr. 15, 1999 (DE) ..... 299 06 651 U

(51) Int. Cl.[7] ..... H01R 13/514
(52) U.S. Cl. ..... 439/752
(58) Field of Search ..... 439/271, 752

(56) References Cited

U.S. PATENT DOCUMENTS 5,116,236 A * 5/1992 Colleran et al. ..... 439/271
5,439,386 A * 8/1995 Ellis et al. ..... 439/271
5,520,548 A * 5/1996 Hotea et al. ..... 439/752

FOREIGN PATENT DOCUMENTS

| | | |
|---|---|---|
| DE | 41 15 119 | 11/1992 |
| EP | 0 352 088 | 1/1990 |
| EP | 0 698 945 | 2/1996 |

* cited by examiner

*Primary Examiner*—Neil Abrams
*Assistant Examiner*—Phuong K T Dinh
(74) *Attorney, Agent, or Firm*—Kenyon & Kenyon

(57) ABSTRACT

A plug connection having a first connector, which can be sealingly coupled to a second connector, is designed such that contact elements of the first connector are secured axially and the unit volume of the plug connection is small. The first connector has contact elements , which, in an end area that is facing the second connector, support locking bodies, which can be overlapped axially in a form-locking manner by a locking element that is movably supported on the first connector. A seal that generates the seal between the two connectors is mounted in the locking element axially downstream and therefore in the spatial vicinity of the end area, as a result of which a pot-shaped plug-in receptacle of the second connector that overlaps the seal is of small axial dimensions. The locking element, if not correctly inserted may block mating of the first and second connectors. This plug connection may advantageously be used in motor vehicles in cramped installation circumstances.

3 Claims, 1 Drawing Sheet

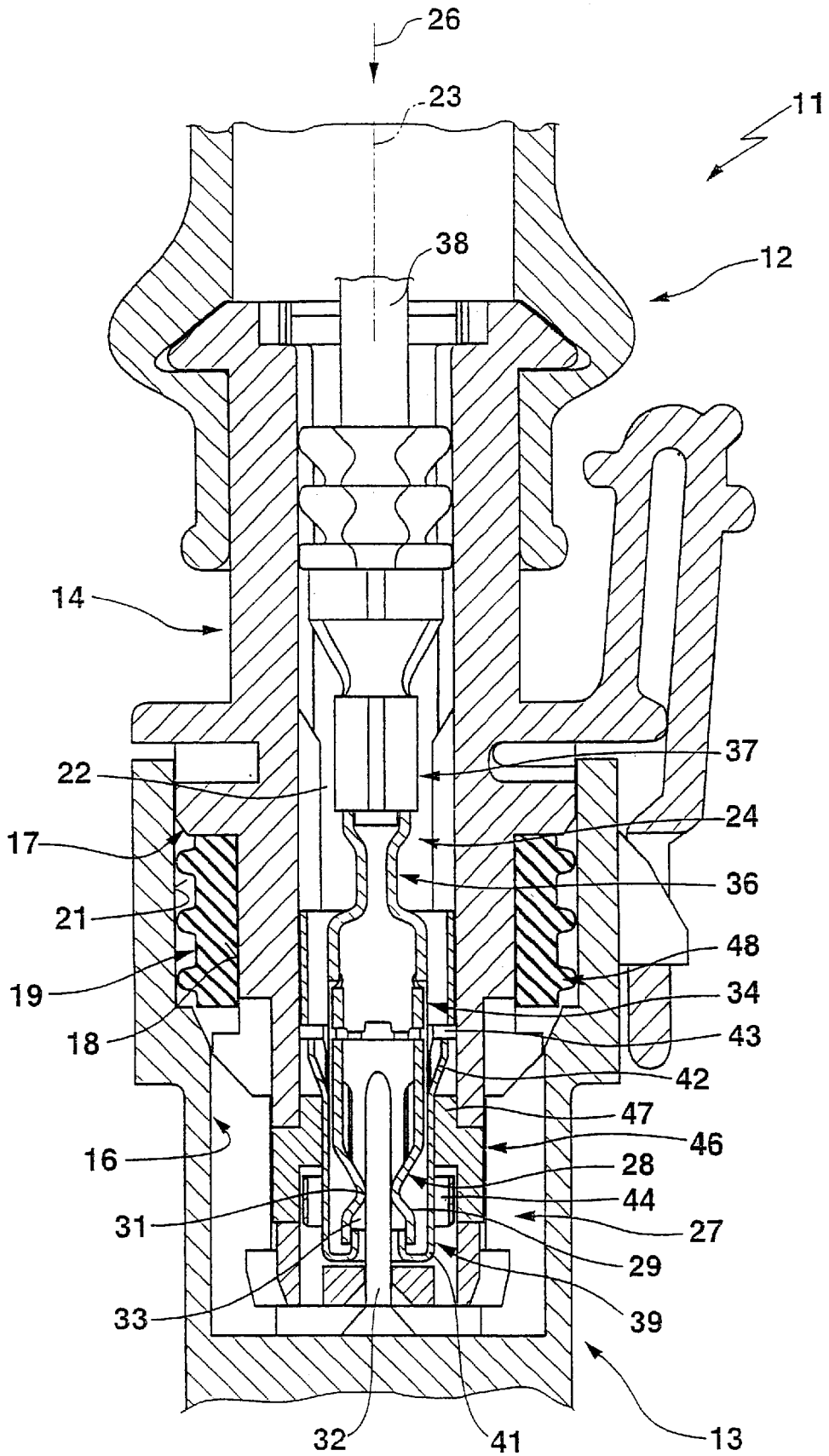
26
23
11
38
12
14
37
22
24
17
36
21
48
19
34
18
43
42
47
16
46
28
44
31
27
29
33
39
32
41
13

ELECTRICAL PLUG-IN CONNECTION

FIELD OF THE INVENTION

The present invention relates to an electrical plug connection according to the species of claim 1.

BACKGROUND INFORMATION

It is known from German Patent No. 41 15 119 describes an electrical plug connection that is composed of a first connector and a second connector assigned to the first. Receiving chambers are arranged in the first plug connection. A contact element connected at its extremity to an electrical line is inserted into each receiving chamber.

When the two connectors are joined, mating contact elements of the second connector penetrate into these facing contact segments, each of which constituting the free end of the contact elements. In order to prevent the contact elements from being pushed back axially by the forces arising in the process, the contact elements are secured in their locked position against any axial displacement by a locking element that is movably mounted on the first connector.

In a disadvantageous manner, the locking element, with respect to a plug-in side of the first connector facing the second connector, is set back axially to the extent that it locks each of the contact elements in an assigned, axially set-back transition segment. Since the guide of the locking element, as a result of its mobility on the first connector, represents an opening on the first connector that exists within the scope of the clearance of motion, a sealing means, which in the coupled state of the plug connection seals off the first connector with respect to the second connector, must be arranged axially downstream in the insertion direction of the second connector in the direction of the first connector, so that when the plug connection is coupled the locking element is situated in the sealed area. However, in an undesirable manner, this arrangement leads to a bulky, large-volume plug connection.

SUMMARY

A plug connection according to the present invention has the advantage that the above-mentioned insufficiency is avoided and a plug connection is realized that has a small unit volume.

When contact elements are used that have at least one locking body in radial separation with respect to the contact segments constituting the free ends of the contact element, the locking element, which in the locking position axially covers these locking bodies in a form-locking manner, can be arranged in spatial proximity to the free ends of the contact elements and thus to the plug-in side of the first connector.

Correspondingly, a sealing element arranged axially downstream of the locking element in the insertion direction of the second connector in the direction of the first connector can be arranged axially upstream of the plug-in side of the first connector, so that, given this arrangement, the overlap of the second connector over the first connector is realized via a short axial coupling path. This makes possible a plug connection of small construction, which can be used even in cramped installation circumstances.

In accordance with an example embodiment of the present invention, the locking element has coding parts which make it possible to lock the plug connection only in response to a second connector that is coded in complementary fashion. The coding parts on the small-dimension locking element can vary without great production expense, so that the housing of the first connector can be manufactured, without its own coding parts, for all coupling variants having the second connector in an unchanged shape. As a result, the plug connection can be manufactured in large-series production in a particularly economically advantageous manner.

BRIEF DESCRIPTION OF THE DRAWING

The FIGURE depicts a plug connection, in a partial cutaway view, seen from the side, in accordance with an example embodiment of the present invention.

DETAILED DESCRIPTION

In the exemplary embodiment, a first connector 12 and a second connector 13, which can be coupled to the former, are depicted as parts of a plug connection 11 in a sectional view. First connector 12 has a housing 14, which is made of electrically insulating plastic. Housing 14 is configured as an approximately rectangular-shaped, elongated body, which, when plug connection 11 is locked, is partially inserted into a fitted, pot-shaped plug-in receptacle 16 of second connector 13.

In a receptacle 17 of lateral surface 18 of housing 14, a seal 19 is fixedly supported, which, when plug connection 11 is locked, provides a sealing function with respect to an interior surface 21 in plug-in opening 16 of second connector 13, so that the interior of plug connection 11 is sealed off across these coupling locations of both connectors 12,13.

Configured in housing 14 is a number of receiving chambers 22, corresponding to the number of poles of first connector 12, aligned axially in their longitudinal extension, the receiving chambers being arranged next to each other in a series, one of which being depicted in the FIGURE in a cutaway view through a longitudinal axis 23.

In each of receiving chambers 22, a contact element 24, which is configured as a planar socket, is inserted along an arrow 26 and is arranged symmetrically with respect to longitudinal axis 23.

Contact element 24 in the plug-in direction has a forward-situated contact segment 28 in an exposed end area 27 of contact element 24. Contact segment 28 is constituted by four spring legs, which are situated in pairs opposite each other symmetrically with respect to longitudinal axis 23 and which, for the purpose of creating contact points with respect to a knife-shaped contact part 32 of second connector 13, meet in a curved manner. At their free ends, spring legs 29 are pulled apart in opposite directions to form a guide area 33.

Connected to contact segment 28 is an elongated central segment 34, in which spring legs 29 run parallel to each other at a wide distance which amounts to many times the thickness of contact part 32. Central segment 34 passes over into a neck-shaped transition segment 36, which is followed by a connecting segment 37 constituting the other end of contact element 24. Transition segment 36, in contrast to neighboring segments 34, 37, has a reduced cross-sectional surface. In connecting segment 37, an electrical line 38 is connected in an electrically contacting manner.

Contact segment 28 and central segment 34 are surrounded by a box-shaped contact carriage 39. From side walls 41, opposite and parallel to each other, of contact carriage 39, locking tongues 42 are released, which, bent to the outside diagonally with respect to longitudinal axis 23, when contact element 24 is completely inserted into receiving chamber 22, grasp from behind projections 43 of the housing, which extend into receiving chamber 22 and thus constitute a primary protection against the extraction of contact element 24 from receiving chamber 22.

In end region 27, contact carriage 39 has locking bodies 44 that extend radially from side walls 41. In housing 14, adjacent to end region 27 of contact element 24, a locking element 46 is supported transverse to the plug-in direction of contact elements 24, and locking body 44 is supported so as to move into receiving chambers 22.

Locking element 46 can be changed from an unlocking position, in which it prevents the two connectors 12, 13 from coming together, to a locking position, in which the coupling of both connectors 12, 13 is possible and in which locking bodies 44 on contact elements 24 are axially overlapped in a form-locking manner by locking element 46. Locking element 46, however, can only be changed to the locking position if contact elements 24, that have been introduced into housing 14, are fully inserted into receiving chambers 22. Locking element 46 then constitutes a secondary protection against the extraction of contact elements 24 from receiving chambers 22.

Locking element 46 is provided with parts 47, which make possible the locking of plug connection 11 only in response to a second connector 13 that is configured in a complementary fashion. Thus, housing 14 without parts 47 can be manufactured cost-effectively in large quantities in a unitary configuration, because the first connector 12 is prevented from being mated with a wrong second connector 13 by means of a small and easily replaceable locking element 46.

Seal 19 is fixedly supported on lateral surface 18 of housing 14, downstream from locking element 46 in the axial 35 direction and at a distance radially with respect to transition segment 36 and an adjoining part of central segment 34. Seal 19 is configured as a circumferential, closed, rubber-elastic radial seal, which is adjusted to the shape of housing 14, and which is elongated axially by contact elements 24 arranged in a series. Seal 19 has circumferential sealing beads 48 that protrude radially to the outside, which, when plug connection 11 is locked, are supported on inner surface 21 of pot-shaped plug-in receptacle 16 of second connector 13 in a form-locking manner, thus sealing plug connection 11 in a linear fashion.

As a result of the spatial proximity of seal 19 to exposed end area 27 of contact elements 24 and to contact segment 28 facing second connector 13, plug-in receptacle 16 in its axial extension can be kept short for the purpose of encompassing sealing means 19.

This arrangement, which is made possible by mounting locking element 46 and locking bodies 44 in one part of first connector 12, which is adjacent to second connector 13, leads to a small-dimensioned plug connection 11, which can be used also in cramped installation circumstances, such as are often encountered in motor vehicles.

What is claimed is:

1. An electrical plug connection, comprising:

a first connector including a housing, the housing composed of insulating material and including a plurality of receiving chambers situated next to each other, each respective receiving chamber configured to receive in an axial direction a respective contact element, each respective contact element having, in a plug-in direction, a forward-situated contact segment in an exposed end area, a central segment, a neck-shaped transition segment and a connecting segment being coupled to a second end of the contact element, the contact segment being surrounded by a contact carriage on which at least one locking body is mounted externally;

a second connector, the first connector being detachably connected to the second connector in the axial direction;

a locking element movably supported on the housing, the locking element being moveable, when each respective contact element is fully inserted into the respective receiving chamber, transverse to the insertion direction of each respective contact element, from an unlocking position into a locking position for securing each respective contact element against axial displacement, the locking element axially overlapping the locking body in the locking position in a form-locking manner; and a seal sealing the first connector with respect to the second connector when the first connector and the second connector are in a coupled state, the seal being arranged, at least partially, at a radial distance with respect to the transition segment.

2. The plug connection according to claim 1, wherein the contact carriage is box-shaped and is formed on a side wall in an end area of the at least one locking body, the end area extending transverse with respect to a direction of motion of the locking element.

3. The plug connection according to claim 1, wherein the seal is configured as a radial seal, and wherein when the first and second connectors are fully mated, the seal is supported on an interior surface of a plug-in receiver of the second connector in a force-locking manner.

* * * * *